US009799270B2

(12) United States Patent
Li et al.

(10) Patent No.: US 9,799,270 B2
(45) Date of Patent: Oct. 24, 2017

(54) PIXEL CIRCUIT, DISPLAY PANEL AND DISPLAY DEVICE

(71) Applicant: BOE TECHNOLOGY GROUP CO., LTD., Beijing (CN)

(72) Inventors: Yongqian Li, Beijing (CN); Yicheng Lin, Beijing (CN); Quanhu Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/226,702

(22) Filed: Aug. 2, 2016

(65) Prior Publication Data

US 2017/0193906 A1 Jul. 6, 2017

(30) Foreign Application Priority Data

Jan. 5, 2016 (CN) ..... 2016 1 0006968

(51) Int. Cl.
*G09G 3/3258* (2016.01)

(52) U.S. Cl.
CPC ... *G09G 3/3258* (2013.01); *G09G 2300/0426* (2013.01); *G09G 2310/08* (2013.01)

(58) Field of Classification Search
CPC ..... G09G 3/30–3/3291; G09G 2300/0426; G09G 2310/08
See application file for complete search history.

(56) References Cited

U.S. PATENT DOCUMENTS

| | | | | |
|---|---|---|---|---|
| 9,330,605 | B2 * | 5/2016 | Park | G09G 3/3291 |
| 9,626,906 | B2 * | 4/2017 | Kim | G09G 3/3233 |
| 2003/0227262 | A1 | 12/2003 | Kwon | |
| 2005/0017934 | A1 | 1/2005 | Chung et al. | |
| 2005/0093464 | A1 | 5/2005 | Shin et al. | |
| 2006/0082528 | A1 * | 4/2006 | Guo | G09G 3/3233 345/82 |
| 2008/0036704 | A1 | 2/2008 | Kim et al. | |
| 2008/0036706 | A1 * | 2/2008 | Kitazawa | G09G 3/3233 345/76 |
| 2009/0051628 | A1 | 2/2009 | Kwon | |
| 2014/0092076 | A1 | 4/2014 | Lee | |
| 2015/0084946 | A1 * | 3/2015 | Shim | G09G 3/3258 345/212 |

(Continued)

FOREIGN PATENT DOCUMENTS

| | | | |
|---|---|---|---|
| CN | 1577453 | A | 2/2005 |
| CN | 1684132 | A | 10/2005 |

(Continued)

OTHER PUBLICATIONS

Office Action in Chinese Application No. 201610006968.4 dated Jun. 12, 2017, with English translation.

*Primary Examiner* — Dmitriy Bolotin
(74) *Attorney, Agent, or Firm* — Blakely Sokoloff Taylor & Zafman LLP

(57) ABSTRACT

Disclosed is a pixel circuit which includes a multiplexing module and a plurality of sub-pixels. Signals for detecting parameters of respective sub-pixels are transferred via a sensing line in a time-divisional manner. For each sub-pixel, connection to the data line and the sensing line is achieved via a common terminal. Further disclosed are a display panel and a display device.

14 Claims, 7 Drawing Sheets

(56) References Cited

U.S. PATENT DOCUMENTS

| | | | | |
|---|---|---|---|---|
| 2015/0130785 | A1* | 5/2015 | Shin | G09G 3/3233 345/213 |
| 2015/0138179 | A1* | 5/2015 | Park | G09G 3/3233 345/212 |
| 2015/0145845 | A1* | 5/2015 | Nam | G09G 3/3233 345/209 |
| 2015/0187276 | A1* | 7/2015 | Shim | G09G 3/3233 345/77 |
| 2016/0111042 | A1* | 4/2016 | Pyeon | G09G 3/3208 345/212 |
| 2016/0293103 | A1* | 10/2016 | Kimura | G09G 3/3233 |
| 2017/0038898 | A1* | 2/2017 | Kim | G09G 3/3225 |
| 2017/0046006 | A1* | 2/2017 | Kim | G02F 1/13338 |
| 2017/0061891 | A1* | 3/2017 | Qian | G09G 3/3266 |
| 2017/0169767 | A1* | 6/2017 | Song | G09G 3/3291 |

FOREIGN PATENT DOCUMENTS

| | | | |
|---|---|---|---|
| CN | 101123071 | A | 2/2008 |
| CN | 101373578 | A | 2/2009 |
| CN | 103714777 | A | 4/2014 |

* cited by examiner

PIXEL CIRCUIT, DISPLAY PANEL AND DISPLAY DEVICE

CROSS-REFERENCE TO THE RELATED APPLICATIONS

The present application claims the benefit of Chinese Patent Application No. 201610006968.4, filed on Jan. 5, 2016, the entire disclosure of which is incorporated herein by reference.

TECHNICAL FIELD

The present disclosure relates to the field of display technology, and particularly to a pixel circuit, a display panel and a display device.

BACKGROUND

When compensation is performed for an organic light-emitting diode (OLED) pixel circuit from outside the pixel circuit, an extra sensing line is needed to transfer to/from the OLED pixel circuit signals for detecting parameters of the OLED pixel circuit (e.g., a threshold voltage of a driving transistor, and a threshold voltage of the OLED). Based on the detected parameters, a compensation processing circuit outside the pixel circuit may perform compensation for a data voltage that is supplied to the OLED pixel circuit via a source driving chip.

However, addition of the sensing line in the pixel circuit causes reduction of an aperture ratio of the pixel. Moreover, providing each sub-pixel or each pixel with a corresponding sensing line requires a great number of sensing channels of the compensation processing circuit. This may cause increase of manufacturing costs.

SUMMARY

Embodiments of the present disclosure provide a pixel circuit, a display panel and a display device, which seek to improve the aperture ratio of the pixel and reduce the number of sensing lines needed when compensation is performed for the pixel from outside.

According to an aspect of the present disclosure, a pixel circuit is provided comprising: a multiplexing module having a data terminal connected to a data line, a sensing terminal connected to a sensing line, a data control terminal for receiving a data control signal, a sensing control terminal for receiving a sensing control signal, a plurality of pixel control terminals for receiving respective pixel control signals, and a plurality of common terminals; and a plurality of sub-pixels comprising respective light-emitting devices and respective driving modules for driving the light-emitting devices. Each of the light-emitting devices has an input terminal. Each of the driving modules is connected to a corresponding one of the common terminals and the input terminal of a corresponding one of the light-emitting devices, and has a first scanning terminal connected to a first scanning line and a second scanning terminal connected to a second scanning line. The plurality of pixel control terminals correspond one-to-one with the plurality of sub-pixels, and the plurality of common terminals correspond one-to-one with the plurality of sub-pixels. In a detection mode for each sub-pixel, the multiplexing module is configured to, in response to the data control signal, the sensing control signal, and the pixel control signal received by one of the plurality of pixel control terminals that corresponds to the sub-pixel, successively transfer a detection reset voltage from the sensing line and a detection voltage from the data line to one of the plurality of common terminals that corresponds to the sub-pixel, and the driving module of the sub-pixel is configured to, in response to the first scanning signal from the first scanning line and the second scanning signal from the second scanning line, reset a voltage at the input terminal of the light-emitting device of the sub-pixel based on the detection reset voltage, cause a change in the voltage at the input terminal of the light-emitting device of the sub-pixel based on the detection voltage, and further transfer the changed voltage to the common terminal corresponding to the sub-pixel for output through the sensing line. In a light-emitting mode for each sub-pixel, the multiplexing module is configured to, in response to the data control signal, the sensing control signal, and the pixel control signal received by one of the plurality of pixel control terminals that corresponds to the sub-pixel, successively transfer a light-emitting reset voltage from the sensing line and a data voltage from the data line to one of the plurality of common terminals that corresponds to the sub-pixel, and the driving module of the sub-pixel is configured to, in response to the first scanning signal from the first scanning line and the second scanning signal from the second scanning line, reset a voltage at the input terminal of the light-emitting device of the sub-pixel based on the light-emitting reset voltage, and drive the light-emitting device of the sub-pixel to emit light based on the data voltage.

In some embodiments, the multiplexing module comprises a first multiplexing unit and a second multiplexing unit. The first multiplexing unit has the data terminal, the sensing terminal, the data control terminal and the sensing control terminal, and is configured to, in response to the data control signal and the sensing control signal, selectively couple one of the data terminal and the sensing terminal to a first node.

The second multiplexing unit has the plurality of pixel control terminals and the plurality of common terminals, and is configured to, in response to the pixel control signals received by the plurality of pixel control terminals, selectively couple the first node to one of the plurality of common terminals.

In some embodiments, the second multiplexing unit comprises a first switch unit, a second switch unit and a third switch unit, and the plurality of sub-pixels comprise a first sub-pixel, a second sub-pixel and a third sub-pixel.

In some embodiments, the first switch unit comprises a first transistor which has a gate connected to one of the plurality of pixel control terminals that corresponds to the first sub-pixel, a first electrode connected to the first node, and a second electrode connected to one of the plurality of common terminals that corresponds to the first sub-pixel.

In some embodiments, the second switch unit comprises a second transistor which has a gate connected to one of the plurality of pixel control terminals that corresponds to the second sub-pixel, a first electrode connected to the first node, and a second electrode connected to one of the plurality of common terminals that corresponds to the second sub-pixel.

In some embodiments, the third switch unit comprises a third transistor which has a gate connected to one of the plurality of pixel control terminals that corresponds to the third sub-pixel, a first electrode connected to the first node, and a second electrode connected to one of the plurality of common terminals that corresponds to the third sub-pixel.

In some embodiments, the first multiplexing unit comprises: a fourth transistor which has a gate connected to the data control terminal, a first electrode connected to the data terminal, and a second electrode connected to the first node; and a fifth transistor which has a gate connected to the sensing control terminal, a first electrode connected to the first node, and a second electrode connected to the sensing terminal.

In some embodiments, the driving module of each sub-pixel comprises a reset unit, a driving unit and a write unit. The write unit has the first scanning terminal and is connected to a second node and the common terminal corresponding to the sub-pixel. The write unit is configured to, in response to the first scanning signal, couple the common terminal corresponding to the sub-pixel to the second node. The driving unit is connected to the second node, a first power supply voltage and the input terminal of the light-emitting device. The driving unit is configured to, in response to the detection voltage provided to the second node, to cause the change in the voltage at the input terminal of the light-emitting device in the detection mode, and, in response to the data voltage provided to the second node, drive the light-emitting device of the sub-pixel to emit light in the light-emitting mode. The reset unit has the second scanning terminal and is connected to the input terminal of the light-emitting device and the common terminal corresponding to the sub-pixel. The reset unit is configured to, in the detection mode in response to the second scanning signal, reset the voltage at the input terminal of the light-emitting device based on the detection reset voltage and transfer the changed voltage at the input terminal of the light-emitting device which is caused by application of the detection voltage at the second node to the common terminal corresponding to the sub-pixel, and, in the light-emitting mode in response to the second scanning signal, reset the voltage at the input terminal of the light-emitting device based on the light-emitting reset voltage.

In some embodiments, the write unit comprises a sixth transistor which has a gate connected to the first scanning terminal, a first electrode connected to the second node, and a second electrode connected to the common terminal corresponding to the sub-pixel.

In some embodiments, the driving unit comprises: a seventh transistor which has a gate connected to the second node, a first electrode connected to the first power supply voltage, and a second electrode connected to the input terminal of the light-emitting device of the sub-pixel; and a capacitor which has a first terminal connected to the second node and a second terminal connected to the input terminal of the light-emitting device of the sub-pixel.

In some embodiments, the reset unit comprises an eighth transistor which has a gate connected to the second scanning terminal, a first electrode connected to the common terminal corresponding to the sub-pixel, and a second electrode connected to the input terminal of the light-emitting device of the sub-pixel.

In some embodiments, the light-emitting devices are organic light-emitting diodes.

According to another aspect of the present disclosure, a display panel is provided comprising a display substrate and a plurality of pixel circuits as described above that are formed on the display substrate.

According to a further aspect of the present disclosure, a display device is provided comprising the display panel as described above.

These and other aspects of the present disclosure will be apparent from and elucidated with reference to the embodiment(s) described hereinafter.

DETAILED DESCRIPTION

Embodiments of the present disclosure will be described in detail with reference to the accompanying drawings.

Figure 1:
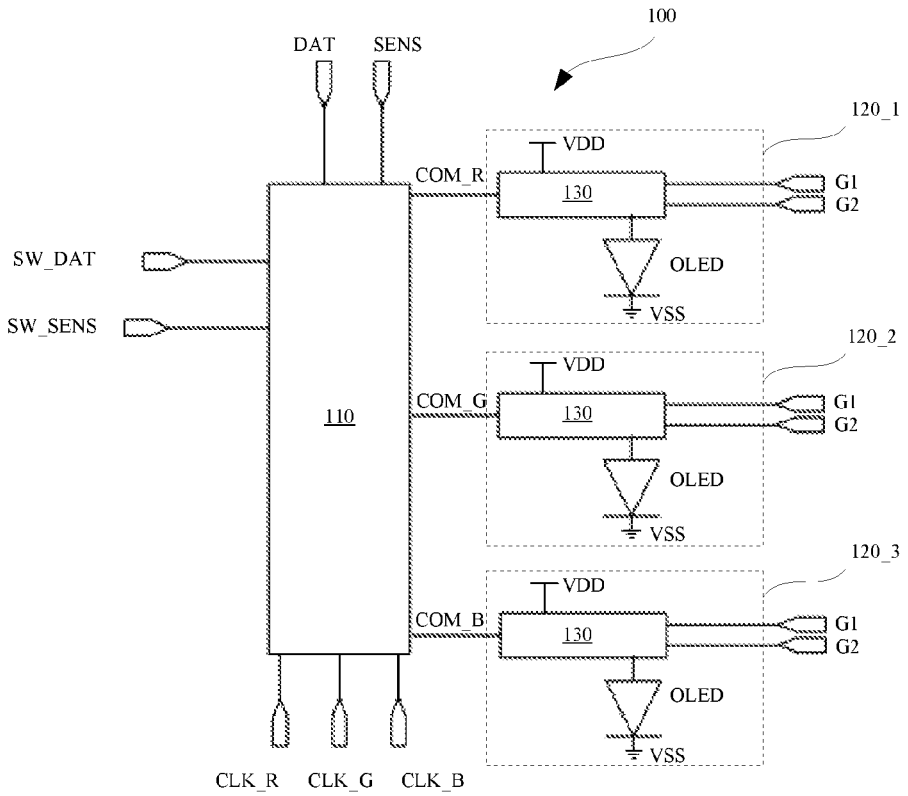
FIG. 1 illustrates a block diagram of a pixel circuit according to an embodiment of the present disclosure.

FIG. 1 illustrates a block diagram of a pixel circuit 100 according to an embodiment of the present disclosure. As shown in FIG. 1, the pixel circuit 100 comprises a multiplexing module 110 and a plurality of sub-pixels 120_1, 120_2 and 120_3. The sub-pixels 120_1, 120_2 and 120_3 may be used to emit different primary colors (e.g., red, green and blue), and may be collectively referred to as sub-pixels 120 hereinafter.

The multiplexing module 110 has a data terminal DAT connected to a data line, a sensing terminal SENS connected to a sensing line, a data control terminal SW_DAT for receiving a data control signal, a sensing control terminal SW_SENS for receiving a sensing control signal, a plurality of pixel control terminals CLK_R, CLK_G and CLK_B for receiving respective pixel control signals, and a plurality of common terminals COM_R, COM_G and COM_B. The plurality of pixel control terminals CLK_R, CLK_G and CLK_B correspond one-to-one with the plurality of sub-pixels 120, and the plurality of common terminals COM_R, COM_G and COM_B correspond one-to-one with the plurality of sub-pixels 120.

The plurality of sub-pixels 120 comprise respective light-emitting devices such as OLED devices and respective driving modules 130 for driving the OLED devices. Each of the OLED devices has an input terminal (i.e., an anode). Each of the driving modules 130 is connected to a corresponding one of the common terminals COM_R, COM_G and COM_B and the input terminal of a corresponding one of the OLED devices, and has a first scanning terminal G1 connected to a first scanning line and a second scanning terminal G2 connected to a second scanning line.

In a detection mode for each sub-pixel 120, the multiplexing module 110 is configured to, in response to the data control signal received by the data control terminal SW_DAT, the sensing control signal received by the sensing control terminal SW_SENS, and the pixel control signal received by one of the plurality of pixel control terminals CLK_R, CLK_G and CLK_B that corresponds to the sub-pixel 120, successively transfer a detection reset voltage from the sensing line and a detection voltage from the data line to one of the plurality of common terminals COM_R, COM_G and COM_B that corresponds to the sub-pixel 120, and the driving module 130 of the sub-pixel 120 is configured to, in response to the first scanning signal from the first scanning line and the second scanning signal from the second scanning line, reset a voltage at the input terminal of the OLED device of the sub-pixel 120 based on the detection reset voltage, cause a change in the voltage at the input terminal of the OLED device of the sub-pixel 120 based on the detection voltage, and further transfer the changed voltage to the common terminal corresponding to the sub-pixel 120 for output through the sensing line.

In a light-emitting mode for each sub-pixel 120, the multiplexing module 110 is configured to, in response to the data control signal received by the data control terminal SW_DAT, the sensing control signal received by the sensing control terminal SW_SENS, and the pixel control signal received by one of the plurality of pixel control terminals CLK_R, CLK_G and CLK_B that corresponds to the sub-pixel 120, successively transfer a light-emitting reset voltage from the sensing line and a data voltage from the data line to one of the plurality of common terminals COM_R, COM_G and COM_B that corresponds to the sub-pixel 120, and the driving module 130 of the sub-pixel 120 is configured to, in response to the first scanning signal from the first scanning line and the second scanning signal from the second scanning line, reset a voltage at the input terminal of the OLED device of the sub-pixel 120 based on the light-emitting reset voltage, and drive the OLED device of the sub-pixel 120 to emit light based on the data voltage.

Operation of the pixel circuit 100 in the detection mode and the light-emitting mode will be described in detail later.

Figure 2:
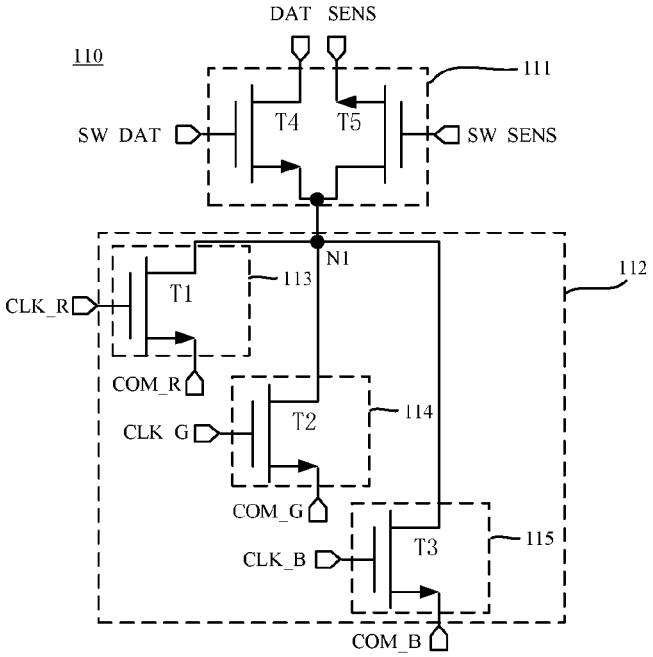
FIG. 2 is a circuit schematic diagram of a multiplexing module of the pixel circuit as shown in FIG. 1.

FIG. 2 is a circuit schematic diagram of the multiplexing module 110 of the pixel circuit 100 as shown in FIG. 1. As shown in FIG. 2, the multiplexing module 110 comprises a first multiplexing unit 111 and a second multiplexing unit 112.

The first multiplexing unit 111 has the data terminal DAT, the sensing terminal SENS, the data control terminal SW_DAT and the sensing control terminal SW_SENS, and is configured to, in response to the data control signal received by the data control terminal SW_DAT and the sensing control signal received by the sensing control terminal SW_SENS, selectively couple one of the data terminal DAT and the sensing terminal SENS to a first node N1. Specifically, the first multiplexing unit 111 comprises a fourth transistor T4 and a fifth transistor T5. The fourth transistor T4 has a gate connected to the data control terminal SW_DAT, a first electrode connected to the data terminal DAT, and a second electrode connected to the first node N1. The fifth transistor T5 has a gate connected to the sensing control terminal SW_SENS, a first electrode connected to the first node N1, and a second electrode connected to the sensing terminal SENS.

The second multiplexing unit 112 has a plurality of pixel control terminals CLK_R, CLK_G and CLK_B and a plurality of common terminals COM_R, COM_G and COM_B, and is configured to, in response to the pixel control signals received by the plurality of pixel control terminals CLK_R, CLK_G and CLK_B, selectively couple the first node N1 to one of the plurality of common terminals COM_R, COM_G and COM_B. Specifically, the second multiplexing unit 112 comprises a first switch unit 113, a second switch unit 114 and a third switch unit 115. Although not shown, the first switch unit 113, the second switch unit 114 and the third switch unit 115 may be connected to the first sub-pixel 120_1, the second sub-pixel 120_2 and the third sub-pixel 120_3 in FIG. 1, respectively. More specifically, the first switch unit 113 comprises a first transistor T1 which has a gate connected to the pixel control terminal CLK_R corresponding to the first sub-pixel 120_1, a first electrode connected to the first node N1, and a second electrode connected to the common terminal COM_R corresponding to the first sub-pixel 120_1. The second switch unit 114 comprises a second transistor T2 which has a gate connected to the pixel control terminal CLK_G corresponding to the second sub-pixel 120_2, a first electrode connected to the first node N1, and a second electrode connected to the common terminal COM_G corresponding to the second sub-pixel 120_2. The third switch unit 115 comprises a third transistor T3 which has a gate connected to the pixel control terminal CLK_B corresponding to the third sub-pixel 120_3, a first electrode connected to the first node N1, and a second electrode connected to the common terminal COM_B corresponding to the third sub-pixel 120_3.

Figure 3:
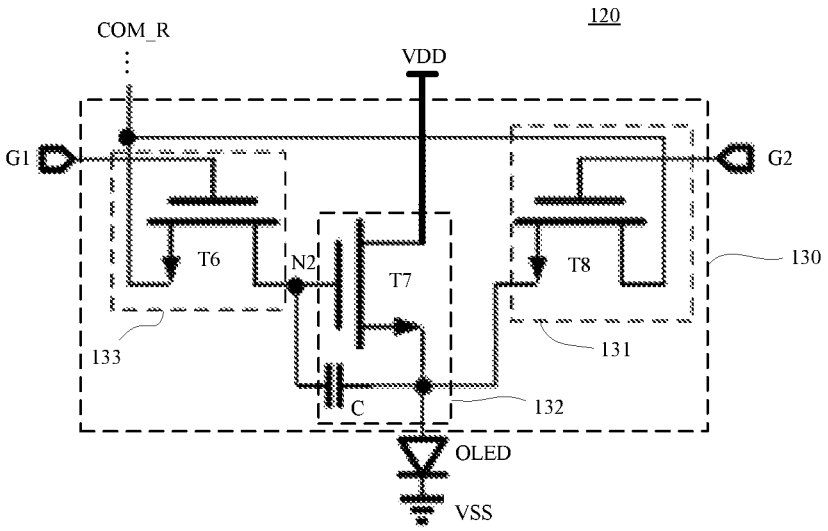
FIG. 3 is a circuit schematic diagram of a sub-pixel of the pixel circuit as shown in FIG. 1.

FIG. 3 is a circuit schematic diagram of the sub-pixel 120 of the pixel circuit 100 as shown in FIG. 1. For ease of description, FIG. 3 shows the sub-pixel 120 that corresponds to the common terminal COM_R, namely, the first sub-pixel 120_1. As shown in FIG. 3, the sub-pixel 120 comprises an OLED device and a driving module 130, and the driving module 130 comprises a reset unit 131, a driving unit 132 and a write unit 133.

The write unit 133 has the first scanning terminal G1 and is connected to the common terminal COM_R corresponding to the sub-pixel 120 and a second node N2. The write unit 133 is configured to, in response to the first scanning signal received by the first scanning terminal G1, couple the common terminal COM_R corresponding to the sub-pixel 120 to the second node N2. Specifically, the write unit 133 comprises a sixth transistor T6 which has a gate connected to the first scanning terminal G1, a first electrode connected to the second node N2, and a second electrode connected to the common terminal COM_R corresponding to the sub-pixel 120.

The driving unit 132 is connected to the second node N2, a first power supply voltage VDD and the input terminal of the OLED device. The driving unit 132 is configured to, in response to a detection voltage provided to the second node N2, to cause a change in the voltage at the input terminal of the OLED device in the detection mode, and, in response to a data voltage provided to the second node N2, drive the OLED device of the sub-pixel 120 to emit light in the light-emitting mode. Specifically, the driving unit 132 comprises a seventh transistor T7 and a capacitor C. The seventh transistor T7 has a gate connected to the second node N2, a first electrode connected to the first power supply voltage VDD, and a second electrode connected to the input terminal of the OLED device of the sub-pixel 120.

The reset unit 131 has a second scanning terminal G2 and is connected to the common terminal COM_R corresponding to the sub-pixel 120 and the input terminal of the OLED device. The reset unit 131 is configured to, in the detection mode in response to the second scanning signal received by the second scanning terminal G2, reset the voltage at the input terminal of the OLED device based on the detection reset voltage and transfer the changed voltage at the input terminal of the OLED device which is caused by application of the detection voltage at the second node N2 to the common terminal COM_R corresponding to the sub-pixel 120, and, in the light-emitting mode in response to the second scanning signal, reset the voltage at the input terminal of the OLED device based on the light-emitting reset voltage. Specifically, the reset unit 131 comprises an eighth transistor T8 which has a gate connected to the second scanning terminal G2, a first electrode connected to the common terminal COM_R corresponding to the sub-pixel 120, and a second electrode connected to the input terminal of the OLED device of the sub-pixel 120.

Figure 4:
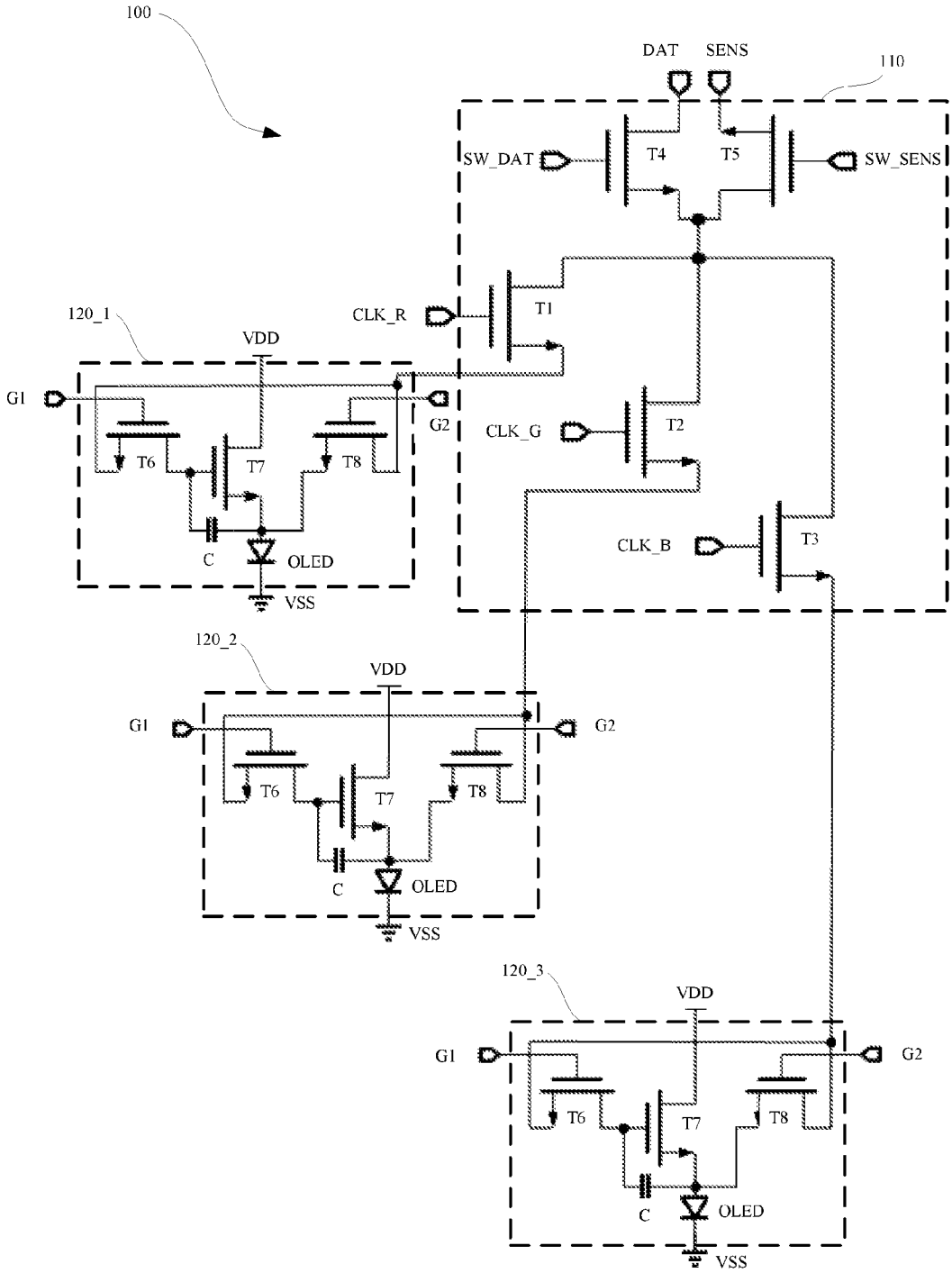
FIG. 4 is a circuit schematic diagram of the pixel circuit as shown in FIG. 1.

FIG. 4 is a circuit schematic diagram of the pixel circuit 100 as shown in FIG. 1. FIG. 4 shows the circuit connection between the multiplexing module 110 and the plurality of sub-pixels 120_1, 120_2 and 120_3. It should be appreciated that the respective sub-pixels 120 as shown may have the same structure, except that their OLED devices emit different primary colors.

In embodiments, the transistors T1-T8 may be thin film transistors (TFT) or metal oxide semiconductor (MOS) transistor. These transistors are usually fabricated so that their first electrodes and second electrodes may be used interchangeably. In embodiments, the transistors T1-T8 are shown as N-type transistors. However, the present disclosure is not so limited. In other embodiments, at least one of the transistors T1-T8 may be a P-type transistor. In this case, a low level is used to turn on the P-type transistor, and a high level is used to turn off the P-type transistor.

Operation of the pixel circuit 100 according to embodiments of the present disclosure in the detection mode and the light-emitting mode is described below in detail. Specifically, the detection mode may include a detection mode for the driving transistor and a detection mode for the light-emitting device OLED.

Figure 5:
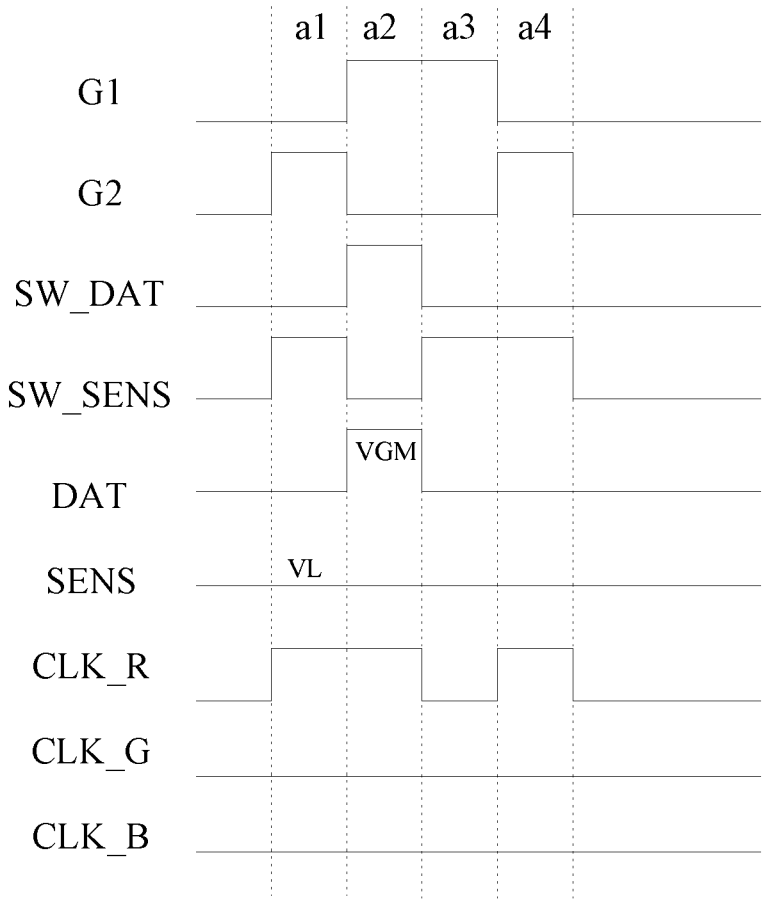
FIG. 5 is a time sequence diagram of the pixel circuit as shown in FIG. 4 in a driving transistor detection mode.
Figure 6:
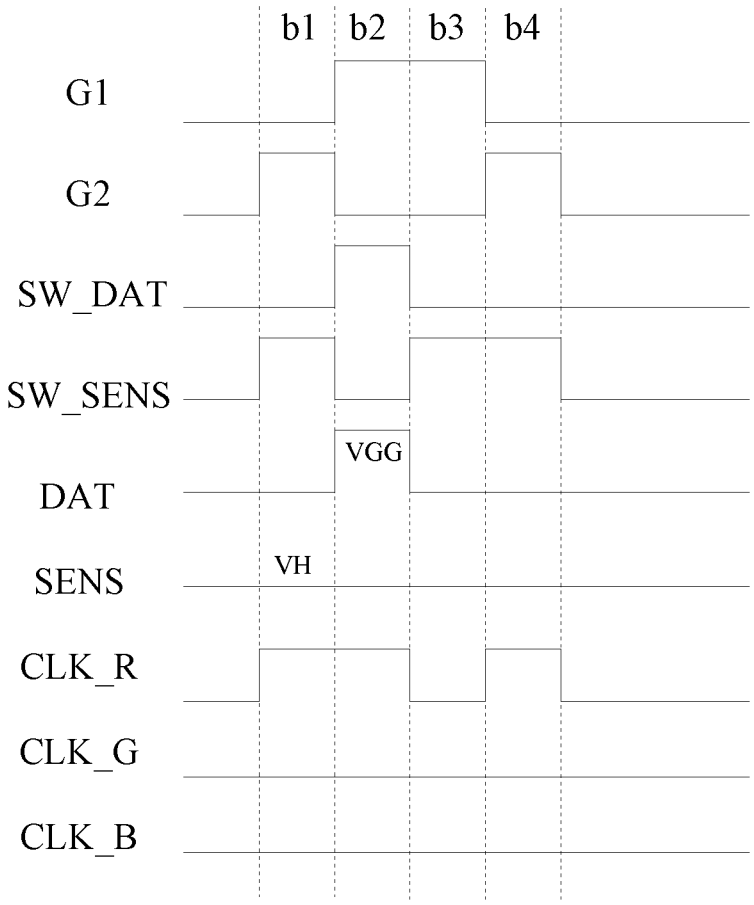
FIG. 6 is a time sequence diagram of the pixel circuit as shown in FIG. 4 in a light-emitting device detection mode.
Figure 7:
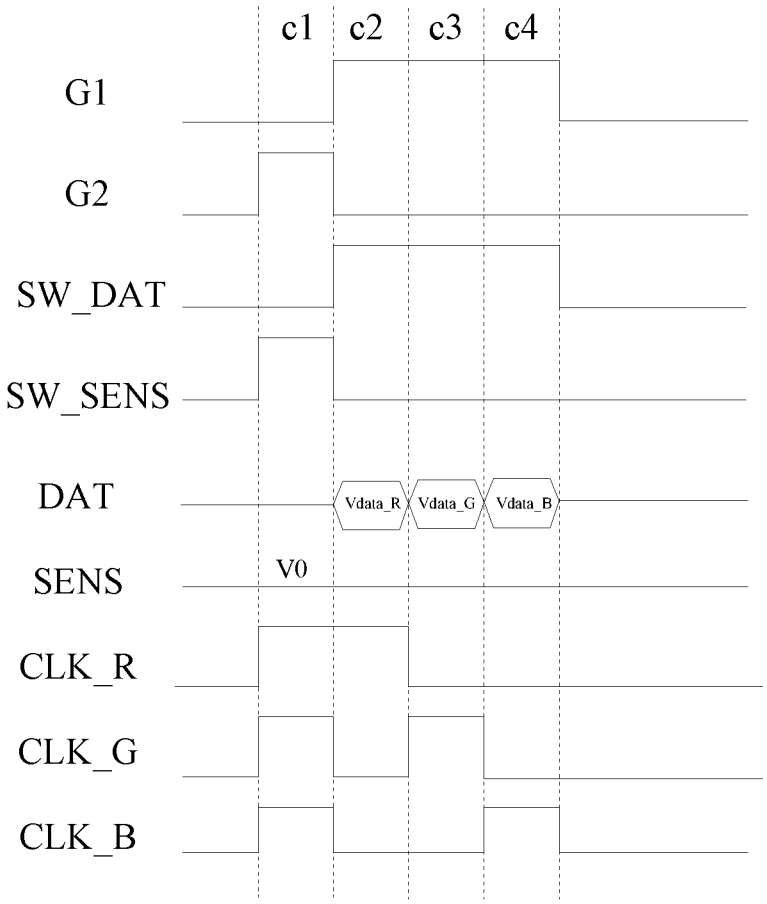
FIG. 7 is a time sequence diagram of the pixel circuit as shown in FIG. 4 in a light-emitting mode.

FIG. 5 is a time sequence diagram of the pixel circuit 100 as shown in FIG. 4 in the driving transistor detection mode, FIG. 6 is a time sequence diagram of the pixel circuit 100 as shown in FIG. 4 in the light-emitting device detection mode, and FIG. 7 is a time sequence diagram of the pixel circuit 100 as shown in FIG. 4 in the light-emitting mode.

Hereunder, operation of the pixel circuit 100 in the detection mode for the driving transistor (i.e., the seventh transistor T7) is described with reference to FIG. 4 and FIG. 5. In the text below, a high level is denoted by "1", and a low level is denoted by "0".

In phase a1, G1=0, G2=1, SW_DAT=0, SW_SENS=1, SENS=VL, DAT=0, CLK_R=1, CLK_G=0, and CLK_B=0, wherein VL is the detection reset voltage in the driving transistor detection mode. Since SW_SENS=1, the fifth transistor T5 is turned on, the detection reset voltage VL from the sensing line is transferred to the first electrodes of the first transistor T1, the second transistor T2 and the third transistor T3. Since CLK_R=1, the first transistor T1 is turned on, and the detection reset voltage VL is transferred to the second electrode of the sixth transistor T6 and the first electrode of the eighth transistor T8 in the sub-pixel 120_1. Since G2=1, the eighth transistor T8 is turned on, and the detection reset voltage VL is transferred to the input terminal of the OLED device. VL is a low-level signal, so the OLED device does not emit light.

In phase a2, G1=1, G2=0, SW_DAT=1, SW_SENS=0, DAT=VGM, CLK_R=1, CLK_G=0, and CLK_B=0, wherein VGM is the detection voltage in the driving transistor detection mode. Since SW_DAT=1, the fourth transistor T4 is turned on, the detection voltage VGM from the data line DAT is transferred to the first electrodes of the first transistor T1, the second transistor T2 and the third transistor T3. Since CLK_R=1, the first transistor T1 is turned on, and the detection voltage VGM is transferred to the second electrode of the sixth transistor T6 and the first electrode of the eighth transistor T8 in the sub-pixel 120_1. Since G1=1, the sixth transistor T6 is turned on, and the detection voltage VGM is transferred to the gate of the seventh transistor T7.

In phase a3, G1=1, G2=0, SW_DAT=0, SW_SENS=1, DAT=0, CLK_R=0, CLK_G=0, and CLK_B=0. This phase is a buffering phase. The voltage at the input terminal of the OLED device slowly rises due to the action of the capacitor C.

In phase a4, G1=0, G2=1, SW_DAT=0, SW_SENS=1, DAT=0, CLK_R=1, CLK_G=0, and CLK_B=0. Since SW_SENS=1, the fifth transistor T5 is turned on. Since CLK_R=1, the first transistor T1 is turned on. Since G2=1, the eighth transistor T8 is turned on. The voltage at the input terminal of the OLED device is transferred to the sensing terminal SENS via the turned-on eighth transistor T8, first transistor T1 and fifth transistor T5.

The voltage at the input terminal of the OLED device may be further transferred to a compensation processing circuit (not shown) via the sensing line for determination of the parameter of the seventh transistor T7. For example, since the voltage at the gate of the seventh transistor T7 is VGM, the voltage at the input terminal (i.e., the second electrode of the seventh transistor T7) of the OLED device can rise slowly from the detection reset voltage VL to VGM-Vth, wherein Vth is the threshold voltage of the seventh transistor T7. Hence, the compensation processing circuit may determine the threshold voltage Vth of the seventh transistor T7 based on the voltage transferred via the sensing line. The compensation processing circuit may further perform compensation for the data voltage provided to the OLED device in the light-emitting module, based on the determined threshold voltage Vth. The compensation processing circuit and its compensation mechanism are beyond the scope of discussion in this text.

The driving transistor detection mode for the sub-pixels 120_2 and 120_3 is the same as the sub-pixel 120_1 and will not be detailed here.

Operation of the pixel circuit 100 in the light-emitting device OLED detection mode is described with reference to FIG. 4 and FIG. 6.

In phase b1, G1=0, G2=1, SW_DAT=0, SW_SENS=1, SENS=VH, DAT=0, CLK_R=1, CLK_G=0, and CLK_B=0, wherein VH is the detection reset voltage in the light-emitting device detection mode. Since SW_SENS=1, the fifth transistor T5 is turned on, the detection reset voltage VH from the sensing line is transferred to the first electrodes of the first transistor T1, the second transistor T2 and the third transistor T3. Since CLK_R=1, the first transistor T1 is turned on, and the detection reset voltage VH is transferred to the second electrode of the sixth transistor T6 and the first electrode of the eighth transistor T8 in the sub-pixel 120_1. Since G2=1, the eighth transistor T8 is turned on, and the detection reset voltage VH is transferred to the input terminal of the OLED device. VH is a high-level signal, so the input terminal of the OLED device is set to a high level to cause the OLED device to commence emitting light.

In phase b2, G1=1, G2=0, SW_DAT=1, SW_SENS=0, DAT=VGG, CLK_R=1, CLK_G=0, and CLK_B=0, wherein VGG is the detection voltage in the light-emitting device detection mode. Since SW_DAT=1, the fourth transistor T4 is turned on, and the detection voltage VGG from the data line is transferred to the first electrodes of the first transistor T1, the second transistor T2 and the third transistor T3. Since CLK_R=1, the first transistor T1 is turned on, and the detection voltage VGG is transferred to the second electrode of the sixth transistor T6 and the first electrode of the eighth transistor T8 in the sub-pixel 120_1. Since G1=1, the sixth transistor T6 is turned on, and the detection voltage VGG is transferred to the gate of the seventh transistor T7.

In phase b3, G1=1, G2=0, SW_DAT=0, SW_SENS=1, DAT=0, CLK_R=0, CLK_G=0, and CLK_B=0. This phase is a buffering phase. The potential at the input terminal of the OLED device slowly falls due to the consumption of the light-emitting device.

In phase b4, G1=0, G2=1, SW_DAT=0, SW_SENS=1, DAT=0, CLK_R=1, CLK_G=0, and CLK_B=0. Since SW_SENS=1, the fifth transistor T5 is turned on. Since CLK_R=1, the first transistor T1 is turned on. Since G2=1, the eighth transistor T8 is turned on. The voltage at the input terminal of the OLED device is transferred to the sensing terminal SENS via the turned-on eighth transistor T8, first transistor T1 and fifth transistor T5.

The voltage at the input terminal of the OLED device may be further transferred via the sensing line to the compensation processing circuit (not shown) for determination of the parameter of the OLED parameter. For example, as the voltage at the input terminal of the OLED device falls slowly from VH, the OLED device transits from a light-emitting state to an extinguishing state. That is, the voltage at the input terminal of the OLED device falls from VH to Von, wherein Von is the threshold voltage of the OLED device. Hence, the compensation processing circuit may determine the threshold voltage Von of the OLED device based on voltage transferred via the sensing line. The compensation processing circuit may further perform compensation for the data voltage provided to the OLED device in the light-emitting module, based on the determined threshold voltage Von. As stated above, the compensation processing circuit and its compensation mechanism are beyond the scope of discussion in the text.

The light-emitting device detection mode for the sub-pixels 120_2 and 120_3 is the same as the sub-pixel 120_1 and will not be detailed here.

Operation of the pixel circuit 100 in the light-emitting mode is described with reference to FIG. 4 and FIG. 7.

In phase c1, G1=0, G2=1, SW_DAT=0, SW_SENS=1, SENS=V0, DAT=0, CLK_R=1, CLK_G=1, and CLK_B=1, wherein V0 is the light-emitting reset voltage in the light-emitting mode which may be equal to the detection reset voltage VL.

Since SW_SENS=1, the fifth transistor T5 is turned on, and the light-emitting reset voltage V0 from the sensing line is transferred to the first electrodes of the first transistor T1, the second transistor T2 and the third transistor T3. Since CLK_R=1, CLK_G=1, and CLK_B=1, the first transistor T1, the second transistor T2 and the third transistor T3 are turned on, and the light-emitting reset voltage V0 is transferred to the second electrodes of respective sixth transistors T6 and the first electrodes of respective eighth transistors T8 of the sub-pixels 120_1, 120_2 and 120_3, respectively. Since G2=1, the eighth transistor T8 is turned on, and the light-emitting voltage reset voltage V0 is transferred to the input terminals of respective OLED devices of the sub-pixels 120_1, 120_2 and 120_3. Hence, the input terminals of the respective OLED devices are reset to the voltage V0.

In phase c2, G1=1, G2=0, SW_DAT=1, SW_SENS=0, DAT=Vdata_R, CLK_R=1, CLK_G=0, and CLK_B=0. Since SW_DAT=1, the fourth transistor T4 is turned on, and the data voltage Vdata_R from the data line is transferred to the first electrodes of the first transistor T1, the second transistor T2 and the third transistor T3. Since CLK_R=1, the first transistor T1 is turned on, and the data voltage Vdata_R is transferred to the second electrode of the sixth transistor T6 and the first electrode of the eighth transistor T8 in the sub-pixel 120_1. Since G1=1, the sixth transistor T6 is turned on, and the data voltage Vdata_R is transferred to the gate of the seventh transistor T7 in the sub-pixel 120_1. The sub-pixel 120_1 begins to emit light. It will be appreciated that the data voltage Vdata_R may be the data voltage that has been compensated by the compensation processing circuit.

In phase c3, G1=1, G2=0, SW_DAT=1, SW_SENS=0, DAT=Vdata_G, CLK_R=0, CLK_G=1, and CLK_B=0. The data voltage Vdata_G from the data line is transferred to the gate of the seventh transistor T7 in the second sub-pixel 120_2. The second sub-pixel 120_2 begins to emit light. Likewise, Vdata_G may be the data voltage that has been compensated by the compensation processing circuit.

In phase c4, G1=1, G2=0, SW_DAT=1, SW_SENS=0, DAT=Vdata_B, CLK_R=0, CLK_G=0, and CLK_B=1. The data voltage Vdata_B from the data line is transferred to the gate of the seventh transistor T7 in the third sub-pixel 120_3. The third sub-pixel 120_3 begins to emit light. Likewise, Vdata_B may be the data voltage that has been compensated by the compensation processing circuit.

Figure 8:
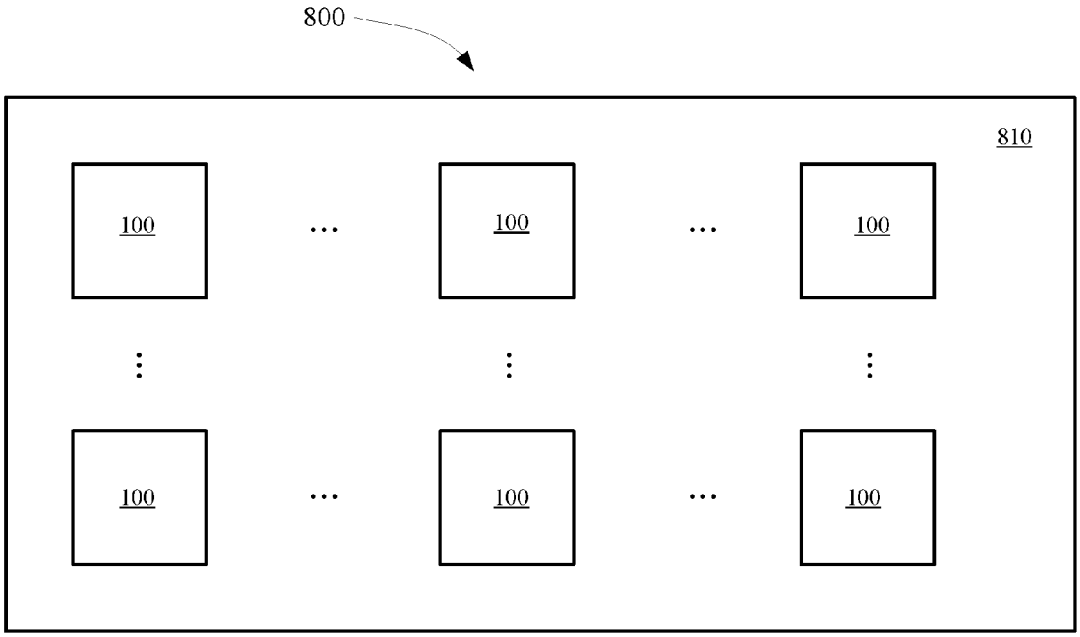
FIG. 8 is a block diagram of a display panel according to an embodiment of the present disclosure.

FIG. 8 is a block diagram of a display panel 800 according to an embodiment of the present disclosure. As shown in FIG. 8, the display panel 800 comprises a display substrate 810 and a plurality of pixel circuits 100 as described in the above embodiments that are formed on the display substrate 810.

The display panel 800 may be a component of a display device. The display device may be applied to any product having a display function such as a mobile phone, a pad, a TV set, a display, a laptop computer, a digital photo frame and a navigator.

Although the pixel circuit 100 is illustrated and depicted as including three sub-pixels in the above embodiments, the present disclosure is not limited thereto. In other embodiments, the pixel circuit 100 may comprise more than three sub-pixels, and the multiplexing module 110 may have common terminals connected to respective sub-pixels and pixel control terminals for controlling connections to the respective sub-pixels. In this case, operation of the pixel circuit in the detection mode and the light-emitting mode is similar to the embodiments depicted above; however it is required to switch between more signal channels in each mode. Depictions of embodiments of the pixel circuit comprising more than three sub-pixels are omitted for the sake of brevity.

In the pixel circuit according to embodiments of the present disclosure, a multiplexing module corresponds to multiple sub-pixels so that signals for detecting parameters of respective sub-pixels may be transferred via a sensing line in a time-divisional manner. This simplifies the wiring of the pixel circuit.

Furthermore, for each sub-pixel, connection to the data line and the sensing line is achieved via a common terminal. Hence, no extra circuit footprint for the sensing line is needed in the sub-pixel, which improves the aperture ratio of the pixel.

Various modifications and variations to the present disclosure may be made by those skilled in the art without departing from the spirit and scope of the present disclosure. Thus, if these modifications and variations fall within the scope of appended claims and equivalents thereof, the present disclosure is also intended to encompass these modifications and variations.

What is claimed is:

1. A pixel circuit, comprising:

a multiplexing module having a data terminal connected to a data line, a sensing terminal connected to a sensing line, a data control terminal for receiving a data control signal, a sensing control terminal for receiving a sensing control signal, a plurality of pixel control terminals for receiving respective pixel control signals, and a plurality of common terminals; and a plurality of sub-pixels comprising respective light-emitting devices and respective driving modules for driving the light-emitting devices, each of the light-emitting devices having an input terminal, each of the driving modules being connected to a corresponding one of the common terminals and the input terminal of a corresponding one of the light-emitting devices and having a first scanning terminal connected to a first scanning line and a second scanning terminal connected to a second scanning line;

wherein the plurality of pixel control terminals correspond one-to-one with the plurality of sub-pixels, and the plurality of common terminals correspond one-to-one with the plurality of sub-pixels;

wherein, in a detection mode for each sub-pixel, the multiplexing module is configured to, in response to the data control signal, the sensing control signal, and the pixel control signal received by one of the plurality of pixel control terminals that corresponds to the sub-pixel, successively transfer a detection reset voltage from the sensing line and a detection voltage from the data line to one of the plurality of common terminals that corresponds to the sub-pixel, and the driving module of the sub-pixel is configured to, in response to the first scanning signal from the first scanning line and the second scanning signal from the second scanning line, reset a voltage at the input terminal of the light-emitting device of the sub-pixel based on the detection reset voltage, cause a change in the voltage at the input terminal of the light-emitting device of the sub-pixel based on the detection voltage, and further transfer the changed voltage to the common terminal corresponding to the sub-pixel for output through the sensing line; and wherein, in a light-emitting mode for each sub-pixel, the multiplexing module is configured to, in response to the data control signal, the sensing control signal, and the pixel control signal received by one of the plurality of pixel control terminals that corresponds to the sub-pixel, successively transfer a light-emitting reset voltage from the sensing line and a data voltage from the data line to one of the plurality of common terminals that corresponds to the sub-pixel, and the driving module of the sub-pixel is configured to, in response to the first scanning signal from the first scanning line and the second scanning signal from the second scanning line, reset a voltage at the input terminal of the light-emitting device of the sub-pixel based on the light-emitting reset voltage, and drive the light-emitting device of the sub-pixel to emit light based on the data voltage.

2. The pixel circuit according to claim 1, wherein the multiplexing module comprises a first multiplexing unit and a second multiplexing unit, wherein:

the first multiplexing unit has the data terminal, the sensing terminal, the data control terminal and the sensing control terminal, and is configured to, in response to the data control signal and the sensing control signal, selectively couple one of the data terminal and the sensing terminal to a first node; and the second multiplexing unit has the plurality of pixel control terminals and the plurality of common terminals, and is configured to, in response to the pixel control signals received by the plurality of pixel control terminals, selectively couple the first node to one of the plurality of common terminals.

3. The pixel circuit according to claim 2, wherein the second multiplexing unit comprises a first switch unit, a second switch unit and a third switch unit, and wherein the plurality of sub-pixels comprise a first sub-pixel, a second sub-pixel and a third sub-pixel.

4. The pixel circuit according to claim 3, wherein the first switch unit comprises a first transistor having a gate connected to one of the plurality of pixel control terminals that corresponds to the first sub-pixel, a first electrode connected to the first node, and a second electrode connected to one of the plurality of common terminals that corresponds to the first sub-pixel.

5. The pixel circuit according to claim 3, wherein the second switch unit comprises a second transistor having a gate connected to one of the plurality of pixel control terminals that corresponds to the second sub-pixel, a first electrode connected to the first node, and a second electrode connected to one of the plurality of common terminals that corresponds to the second sub-pixel.

6. The pixel circuit according to claim 3, wherein the third switch unit comprises a third transistor having a gate connected to one of the plurality of pixel control terminals that corresponds to the third sub-pixel, a first electrode connected to the first node, and a second electrode connected to one of the plurality of common terminals that corresponds to the third sub-pixel.

7. The pixel circuit according to claim 2, wherein the first multiplexing unit comprises:

a fourth transistor having a gate connected to the data control terminal, a first electrode connected to the data terminal, and a second electrode connected to the first node; and a fifth transistor having a gate connected to the sensing control terminal, a first electrode connected to the first node, and a second electrode connected to the sensing terminal.

8. The pixel circuit according to claim 1, wherein the driving module of each sub-pixel comprises a reset unit, a driving unit and a write unit, wherein:

the write unit has the first scanning terminal and is connected to a second node and the common terminal corresponding to the sub-pixel, wherein the write unit is configured to, in response to the first scanning signal, couple the common terminal corresponding to the sub-pixel to the second node;

the driving unit is connected to the second node, a first power supply voltage and the input terminal of the light-emitting device, wherein the driving unit is configured to, in response to the detection voltage provided to the second node, to cause the change in the voltage at the input terminal of the light-emitting device in the detection mode, and, in response to the data voltage provided to the second node, drive the light-emitting device of the sub-pixel to emit light in the light-emitting mode; and the reset unit has the second scanning terminal and is connected to the input terminal of the light-emitting device and the common terminal corresponding to the sub-pixel, wherein the reset unit is configured to, in the detection mode in response to the second scanning signal, reset the voltage at the input terminal of the light-emitting device based on the detection reset voltage and transfer the changed voltage at the input terminal of the light-emitting device which is caused by application of the detection voltage at the second node to the common terminal corresponding to the sub-pixel, and, in the light-emitting mode in response to the second scanning signal, reset the voltage at the input terminal of the light-emitting device based on the light-emitting reset voltage.

9. The pixel circuit according to claim 8, wherein the write unit comprises a sixth transistor having a gate connected to the first scanning terminal, a first electrode connected to the second node, and a second electrode connected to the common terminal corresponding to the sub-pixel.

10. The pixel circuit according to claim 9, wherein the driving unit comprises:

a seventh transistor having a gate connected to the second node, a first electrode connected to the first power supply voltage, and a second electrode connected to the input terminal of the light-emitting device of the sub-pixel; and a capacitor having a first terminal connected to the second node and a second terminal connected to the input terminal of the light-emitting device of the sub-pixel.

11. The pixel circuit according to claim 10, wherein the reset unit comprises an eighth transistor having a gate connected to the second scanning terminal, a first electrode connected to the common terminal corresponding to the sub-pixel, and a second electrode connected to the input terminal of the light-emitting device of the sub-pixel.

12. The pixel circuit according to claim 1, wherein the light-emitting devices are organic light-emitting diodes.

13. A display panel comprising a display substrate and a plurality of pixel circuits according to claim 1 that are formed on the display substrate.

14. A display device comprising the display panel according to claim 13.

* * * * *